United States Patent [19]

Sarver et al.

[11] Patent Number: 4,602,715

[45] Date of Patent: Jul. 29, 1986

[54] SHIPPING CONTAINER FOR ELECTRONIC COMPONENTS

[75] Inventors: Paul H. Sarver, Macungie, Pa.; Donald K. Sears, Greenwood; Gary A. Robbins, Indianapolis, both of Ind.

[73] Assignee: Aero Mayflower Transit Company, Inc., Carmel, Ind.

[21] Appl. No.: 549,753

[22] Filed: Nov. 8, 1983

[51] Int. Cl.[4] ..... B65D 81/02

[52] U.S. Cl. ..... 206/523; 206/561; 206/515; 206/519; 206/591; 220/20; 220/22

[58] Field of Search ..... 206/523, 561, 585, 586, 206/591–594, 499, 503, 515, 516, 519, 387, 454, 449, 555; 229/15, 28 R, 29 D, 29 E; 220/22, 20, 4 R, 70, 4 B, 72, 4 C

[56] References Cited

U.S. PATENT DOCUMENTS

| | | | |
|---|---|---|---|
| D. 169,743 | 6/1953 | Fritz, Jr. et al. . | |
| 393,564 | 11/1888 | Hoyt | 229/29 E |
| 1,890,965 | 12/1932 | Boeye | 229/15 |
| 2,105,645 | 1/1938 | Gemmill | 229/15 |
| 2,516,124 | 7/1950 | Kishibay . | |
| 2,585,180 | 2/1952 | Smith . | |
| 2,718,326 | 9/1955 | Blanc | 206/561 |
| 2,791,362 | 5/1957 | Nute | 229/15 |
| 2,979,246 | 4/1961 | Liebeskind | 206/523 |
| 3,412,888 | 11/1968 | Andrews et al. | 206/499 |
| 3,750,871 | 8/1973 | Cook | 206/523 |
| 3,759,416 | 9/1973 | Constantine . | |
| 3,856,178 | 12/1974 | Norgaard | 206/499 |
| 4,014,450 | 3/1977 | Girotti et al. | 220/72 |
| 4,061,228 | 12/1977 | Johnson | 206/523 |
| 4,079,835 | 3/1978 | Kendig | 220/4 B |
| 4,114,759 | 9/1978 | Maloney, Jr. | 220/72 |
| 4,132,344 | 1/1979 | Jewell | 206/519 |
| 4,241,829 | 12/1980 | Hardy | 206/523 |
| 4,369,883 | 1/1983 | Stravitz | 206/387 |
| 4,396,145 | 8/1983 | Ditton | 229/27 |

FOREIGN PATENT DOCUMENTS

| | | | |
|---|---|---|---|
| 2023102 | 12/1979 | United Kingdom | 206/561 |

*Primary Examiner*—Joseph Man-Fu Moy
*Assistant Examiner*—David T. Fidei
*Attorney, Agent, or Firm*—Barnes & Thornburg

[57] ABSTRACT

A shipping container for electronic components includes first and second container portions. The second container portion is designed for engagement by the first container portion either as a lid or in nested configuration to minimize the vertical height of the two container portions for empty shipping and storage. The first container portion includes grooved interior side walls and partitions engageable in the grooves to reduce the interior size of the first container portion according to the dictates of the component to be shipped. The interior partitions include layers of resilient foam material which form fit to surface features of the component being shipped. The exterior of the first container portion is grooved to provide handgrips, and one pair of opposed walls of the first container portion extends below the level of the container floor to provide feet for stacking multiple containers, to add shock-absorbing capacity to the container, and to provide a recess within which to engage a hand truck. The second, or upper, container portion includes a perimetral flange extending outward from the side wall to stop the projection of the second container portion into the first, both when the second container portion is serving as a lid (right-side up orientation), and when the container portions are assembled empty for shipping and storage (upside-down orientation).

7 Claims, 6 Drawing Figures

28
98
96
94
88
86
24
91
22
58
56
84
58
100
64
56
90
50
62
52
66
60
62
64
100
62
92
50
66
60
62
36
44
46
40
42
20
32
54
42
30
46
70
70
76
26
38
34
72
72
74
76

SHIPPING CONTAINER FOR ELECTRONIC COMPONENTS

This invention relates to shipping containers. It is disclosed in the context of shipping containers for electronic components, such as computers, CRTs, and the like.

Nestable and stackable containers are known. Containers provided with movable interior partitions for dividing the container interior are known. Containers whose interior partitions are provided with layers of shock-absorbent material are also known. Containers having molded-in handles or handgrips are also known. Illustrative of these concepts are the following U.S. Pat. Nos. 2,585,180; 2,516,124; D. 169,743; and 3,759,416.

The present invention seeks to improve upon prior art shipping containers. The invention is disclosed in the context of a shipping container for electronic components or the like. According to one aspect of the invention, a shipping container comprises a first container portion providing a floor and four upstanding side walls in two opposed pairs. A first pair of opposed side walls are provided with facing first engaging means. One engaging means of the pair is provided in each of the opposed side walls of the first pair. The container further comprises a second container portion providing a floor and four upstanding side walls in two opposed pairs. The side walls of the second container portion provide a flange extending generally perpendicularly to the side walls, and the side walls extend beyond the flange. The opposed side walls of the second container portion are spaced to permit them to be engaged snugly within the perimeter provided by the opposed side walls of the first container portion down to the level of the flange to permit nesting of the second container portion in the first container portion either in upright or upside-down configuration. In right-side up configuration, the second container portion provides a lid for the first container portion. In upside-down configuration, the second container portion nests within the first container portion to reduce the space required for shipping of empty first and second container portion assemblies.

Additionally, according to this aspect of the invention, a first interior partition is provided. The first interior partition is provided with second engaging means for engaging the first engaging means to divide the interior of the first container portion.

According to an illustrative embodiment, one of the first and second opposed pairs of side walls of the first container portion extends below the level of the floor to provide a space between the floor and a surface upon which the first portion rests to facilitate handling of the first container portion. These extensions provide additional shock-absorbing capacity for the container, since they can be crushed in a drop down to the height of the container floor, while minimizing shock to components in the container, since they will be compressed in a vertical flat drop, thereby absorbing shock otherwise transmitted to components in the container. These extensions also provide feet for the first container portion.

Additionally according to the present invention, the second pair of opposed side walls of the first container portion is provided with a pair of facing first engaging means, one engaging means of the pair provided in each opposed side wall of the second pair of opposed side walls of the first container portion.

In addition, according to this illustrative embodiment, a second interior partition is provided. The second interior partition includes second engaging means for selective engagement by the first engaging means on the second pair of opposed side walls of the first container portion to divide the interior of the first container portion.

Illustratively, the first and second interior partitions are complementarily notched for use conjunctively to divide the interior of the first container portion into multiple regions.

Additionally, illustratively, each of the first and second interior partitions comprises a layer of shock-absorbent material. The shock-absorbent material of the partitions, which illustratively is a soft foam padding, also adapts to the shape or configuration of components shipped in the container.

According to a specific illustrative embodiment of the invention, each of the first and second pairs of opposed side walls of the first container portion is provided with a plurality of facing inwardly opening pairs of grooves, one groove of each pair provided in each opposed side wall of its respective pair. Multiple first interior partitions are provided, each one sized for selective sliding engagement in any of the pairs of grooves provided on the walls of the first pair. Multiple second interior partitions are provided, each sized for selective sliding engagement in any of the pairs of grooves provided in the walls of the second pair. Each first and second interior partition comprises a layer of shock-absorbent material. Each of the multiple first and second partitions is complementarily notched for use conjunctively with one or more second and first partitions, respectively, to divide the interior of the first container portion into multiple regions.

The invention may best be understood by referring to the following description and accompanying drawings which illustrate the invention. In the drawings.

Figure 1:
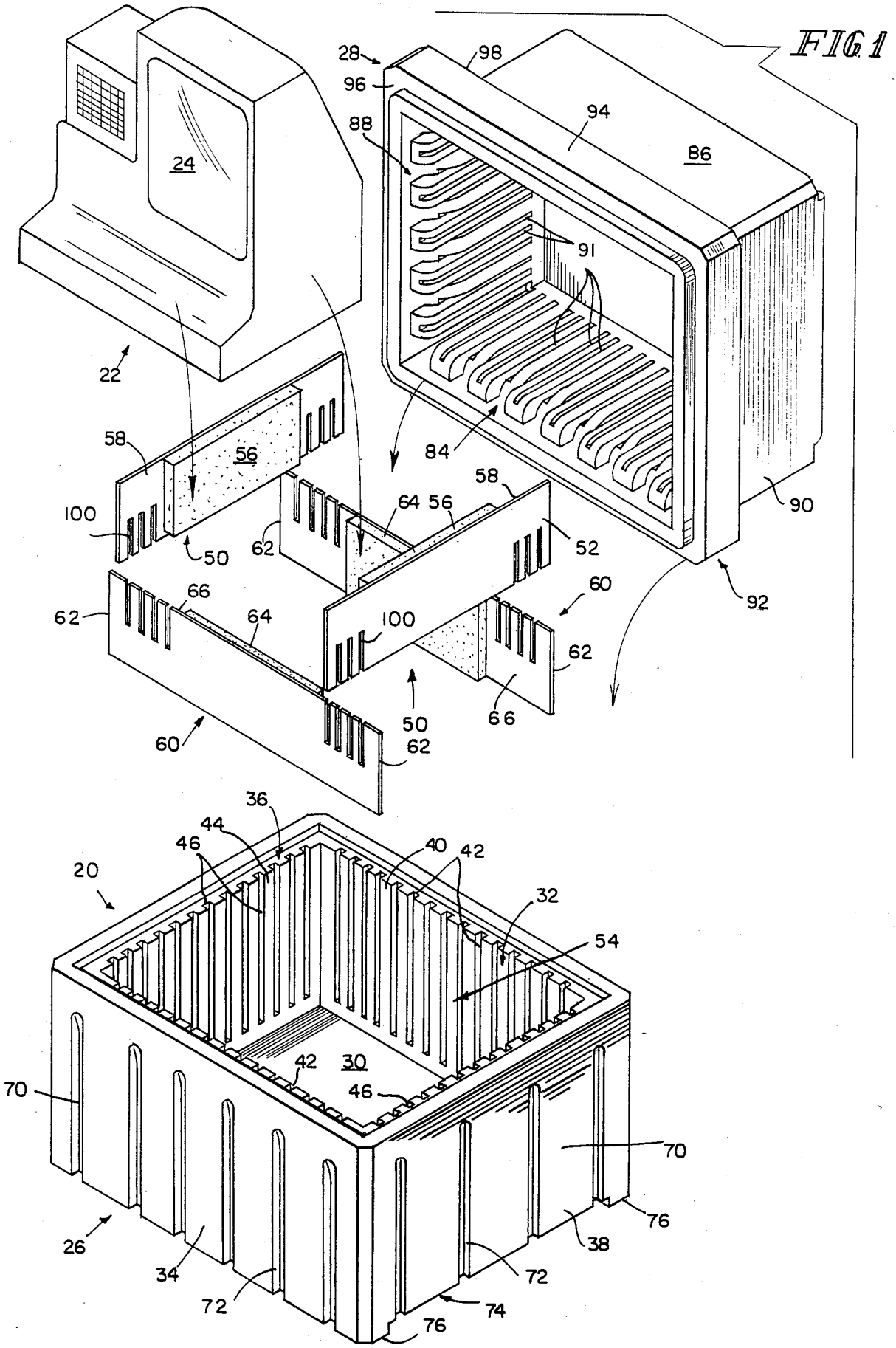
FIG. 1 is an exploded perspective view of a container constructed according to the present invention, and an electronic component to be housed within the container.
Figure 2:
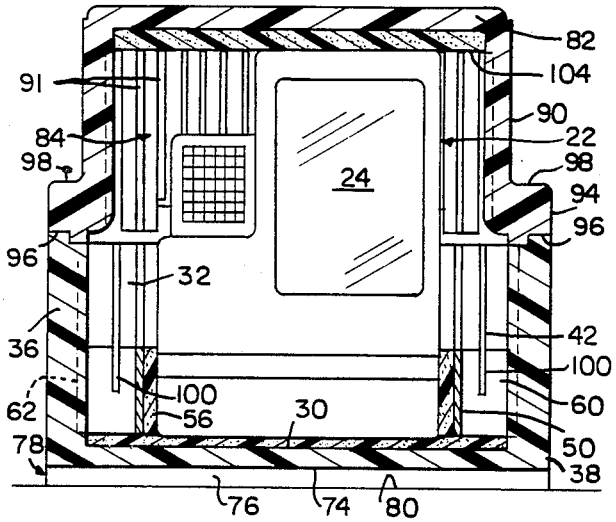
FIG. 2 is a sectional side elevational view of the container of FIG. 1, with the container components in filled shipping orientation.
Figure 3:
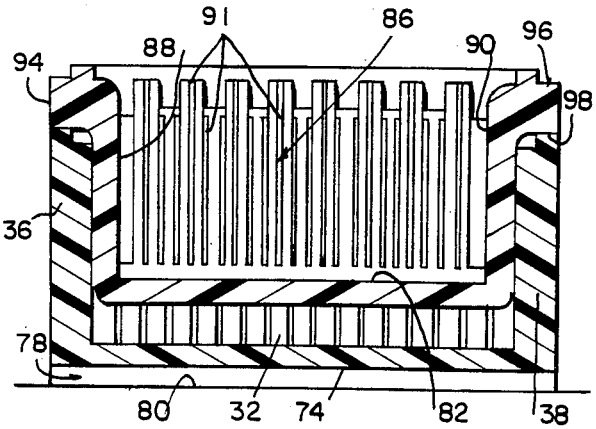
FIG. 3 is a sectional side elevational view of the container of FIGS. 1 and 2, with the container components in nested, empty shipping or storage orientation.

Turning now to the drawings, a shipping container 20 molded from expanded polystyrene foam for electronic components, such as computer terminals 22 with built-in CRTs 24, includes a first container portion 26 and a second container portion 28. Second container portion 28 is designed for nestable engagement with the first container portion 26 in either of two orientations. In the first orientation, illustrated in FIG. 2, second container portion 28 is oriented right-side up on top of first container portion 26, and serves as a lid for first container portion 26. In a second orientation, illustrated in FIG. 3, the second container portion 26 is oriented upside-down with respect to first container portion 26 for low-profile nesting in first container portion 26, so that the combined container portions 26, 28 occupy less vertical height for empty shipping and storage purposes.

First container portion 26 includes a generally planar floor 30, a first pair of opposed side walls 32, 34, and a second pair of opposed side walls 36, 38. All of side walls 32, 34, 36, 38 extend generally perpendicularly upward from the floor 30. Side walls 36, 38 illustratively are perpendicular to side walls 32, 34. The interior surfaces 40 of the first pair of opposed side walls 32, 34 are provided with first engaging means comprising inwardly opening, facing pairs of grooves 42. Each groove 42 on the interior surface 40 of side wall 32 is directly opposite a groove 42 on the interior surface 40 of side wall 34, forming these pairs. Similarly, the interior surfaces 44 of the second pair of opposed side walls 36, 38 are provided with first engaging means comprising pairs of inwardly opening facing grooves 46. Again, each groove 46 on the interior surface 44 of side wall 36 is directly opposite a groove 46 on an interior surface 44 of wall 38 forming a pair of grooves. The grooves 42, 46 are spaced apart along the length of side walls 32, 34 and 36, 38, respectively, at distances determined by the components to be shipped in the containers 20.

A plurality of first interior partitions 50 are provided. Each interior partition 50 includes second engaging means 52 at its vertically extending ends. Illustratively, the engaging means 52 are tabs for engagement by the grooves 42 on the first pair of opposed side walls 32, 34 to divide the interior 54 of the first container portion 26 as dictated by the components to be shipped in the container 20. Each partition 50 includes a layer 56 of shock-absorbent material, such as polyurethane foam, on one of its vertically extending sides 58 further to pad the regions of the first interior partitions 50 which lie against the component to be shipped in the container 20. The padding of layers 56 is soft and pliable and conforms to the contours of the component being shipped. A plurality of second interior partitions 60 are also provided. As was the case with the first interior partitions 50, the second interior partitions 60 include at their vertically extending edges second engaging means 62, such as tabs, for engagement with the grooves 46 provided on the second pair of opposed side walls 36, 38 to divide the interior 54 of the container 20 in accordance with the requirements of the component being shipped in container 20. Again, each interior partition 60 includes a layer 64 of shock-absorbent and contour-adapting material on a side 66 thereof. The interior partitions 60 are situated in their respective grooves 46 to ensure that the layer 64 of shock-absorbent material lies adjacent the component being shipped in container 20 and provides additional protection to the component.

The outsides 70 of the walls 32, 34 and 36, 38, respectively, of the first and second pairs are grooved, as illustrated at 72, to provide handgrips to facilitate the handling of first container portions 26. Additionally, the walls 32, 34 of the first pair extend below the level of the underside 74 of floor 30, as illustated at 76, to provide feet upon which the first portion 26 can rest, and to define a space 78 between the underside 74 of floor 30 and a surface 80 upon which the first container portion 26 rests to facilitate handling. These feet are molded with first container portions 26 from expanded polystyrene foam and, as such, provide a shock-absorption feature for the container 20. The feet provide a cushion between the component within the container 20 and the surface 80 by absorbing impact energy through forced dissipation of air from the cellular porous foam material. The most efficient shock absorption occurs when the foot is compressed to roughly 50% of its original thickness, a degree of compression that avoids excessive irreversible deformation of the foam material. Without the feet, the container would impact upon the far larger area of underside surface 74 of floor 30 and, as such, would provide too firm and unyielding a cushion.

The second container portion 28 includes a generally planar top 82 with a first pair 84, 86 of opposed side walls and a second pair 88, 90 of opposed side walls. Walls 84, 86, 88, 90 extend generally perpendicular to top 82, and walls 84, 86 extend generally perpendicular to walls 88, 90, and parallel to each other. Walls 84, 86 and 88, 90 are spaced apart for engagement with some degree of "overbite," that is, squeezing, jamming, or compression, required to fit walls 84, 86, 88, 90 within the perimeter of the interior 54 of the first container portion 26, with the perimeter of the interior 54 being defined by the walls 32, 34, 36, 38.

The second container portion 28 further is provided with a perimetral flange 92 having an outside surface 94, a bottom surface 96, and a top surface 98. The perimetral flange 92 acts as a stop for engagement of the second container portion 28 into the first container portion 26 in either of the two orientations illustrated in FIGS. 2 and 3. Specifically, when the second container portion 28 is upside-down, surface 98 of flange 92 stops engagement of the second container portion 28 within the first container portion 26 to nest the second container portion 28 within the first container portion 26 for empty shipping and storage. When the second container portion 28 is right-side up with respect to the first container portion 26, surface 96 of the perimetral flange 92 stops engagement between the first and second container portions 26, 28, respectively, to convert the second container portion 28 into a lid.

The overbite or compression required to engage container portions 26, 28 in this orientation provides an excellent seal against environmental conditions such as dust and moisture to protect the component being shipped. It may be desirable to provide a draft of, for example, five degrees on the engaging surfaces of walls 32, 34, 36, 38, 84, 86, 88, 98 to ease engagement and disengagement of the surfaces during assembly, disassembly, opening, and closing of container 20.

Illustratively, the two container portions 26, 28 are of substantially equal vertical height. This permits the container 20 in the orientation illustrated in FIG. 3 to accommodate even tall electronic components such as computer terminals 22 with CRTs 24, while minimizing the vertical height of the container portions 26, 28 in the nested shipping and storage orientation illustrated in FIG. 3.

The interior partitions 50, 60 are all provided with generally vertically extending notches 100 which are configured complementarily to permit the use of multiple first and second interior partitions 50, 60 to divide the interior 54 of the first container portion 26 as required by the size and configuration of the component to be shipped in the container 20. The vertical heights of the interior partitions 50, 60 can also be selected to provide support and shock-absorbent material 56, 64 vertically upward within the container 20 as high as the needs of a particular component, or stack of components, to be shipped within the container 20 dictate.

Figure 4:
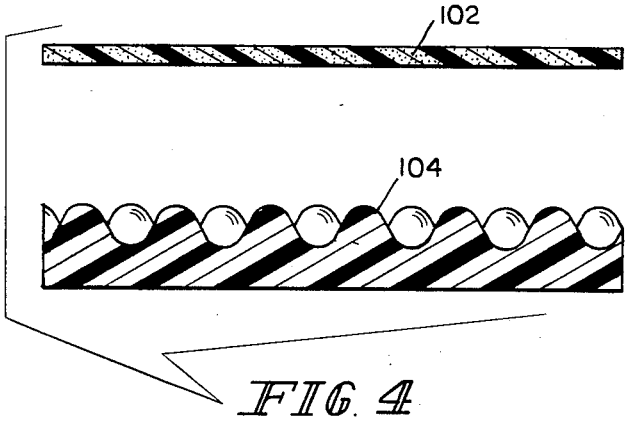
FIG. 4 is a side elevational view of two different types of shock-absorbent padding material for use with the container of FIGS. 1–3.

It will be appreciated that the second container portion 28 walls 84, 86, 88, 90 are also provided with first engaging means such as grooves 91 aligned vertically with grooves 42, 46 provided in the walls 32, 34, 36, 38 of the first container portion 26. One or both of the interior partitions 50, 60 can be made vertically tall enough to extend upward into the second container portion to engage the grooves in walls 84, 86, 88, 90 when the second container portion is in the orientation illustrated in FIG. 2. Thus, lateral support can be provided to a stack of electronic components substantially the full height of the first and second container portions 26, 28 when in their orientations illustrated in FIG. 2. Under such circumstances, suitable shock absorbent material such as flat planar pieces 102 of synthethic foam on convoluted foam 104, both illustrated in FIG. 4, or some other type of padding, can be positioned between adjacent components in the stack.

Illustratively, the first and second container portions 26, 28 are constructed from molded expanded polystyrene (EPS). The density of this material is variable, and can be controlled to meet the requirements of a particular application. Because foam plastic materials, such as expanded polystyrene, tend to develop static surface charges easily, and because such static surface charges can be potentially hazardous to electronic equipment, the expanded polystyrene material from which container portions 26, 28 are formed is impregnated in the manufacturing process with a chemical additive which inhibits the generation of such static charges. Additionally, the layers 56, 64 can be cut from polyethylene foam impregnated with a similar anti-static chemical additive.

Figure 5:
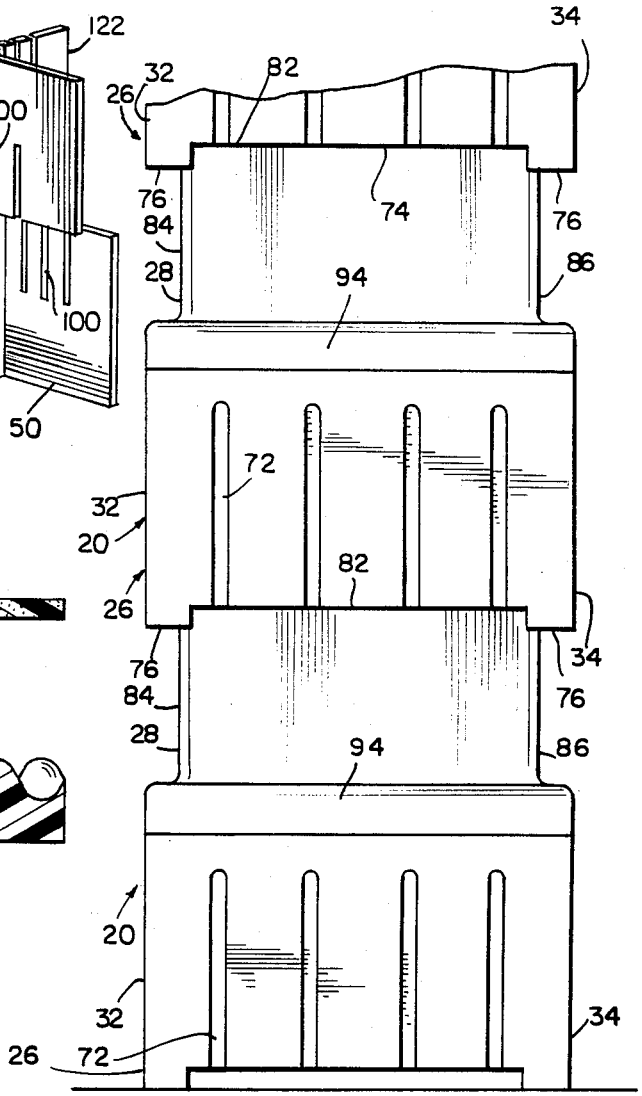
FIG. 5 is a fragmentary side elevational view illustrating a stack of containers in filled shipping orientation.

As best illustrated in FIG. 5, the extensions 76 of walls 32, 34 beneath the underside 74 of floor 30 are spaced to accommodate the first pair 84, 86 of opposed side walls of a subjacent second container portion 28. This facilitates stacking of the containers 20 when the first and second container portions 26, 28 are in their component-shipping orientations illustrated in FIG. 2.

Figure 6:
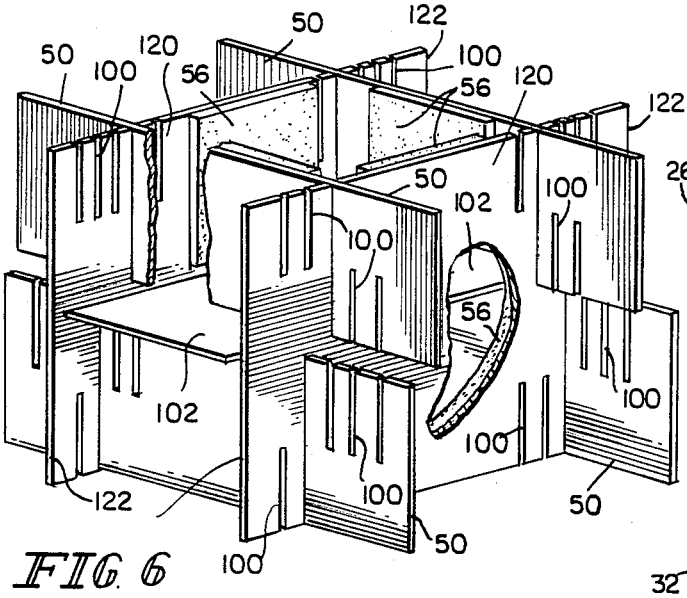
FIG. 6 is a perspective view of another configuration for internal partitions to be used with the shipping container of FIGS. 1–3 and 5.

With reference to FIG. 6, a pair of opposed partitions 120 which are tall enough to extend up substantially to the full height of the interior of the container are shown. The opposite vertical ends 122 of these partitions engage grooves 42 or 46 in opposed interior walls 32, 34 or 36, 38, respectively, as well as engaging grooves 91 in respective walls 84, 86 or 88, 90. These tall partitions 120 are used in conjunction with two pairs of the shorter partitions 50 or 60 and a horizonally oriented pad 102 to divide the interior of a container 20 vertically into two compartments for shipping two components in vertically stacked orientation, and with the lateral support provided by engagement of the vertical partition 120 ends 122 in grooves 42 or 46 and 91 in the first and second container portion 26, 28 side walls, respectively.

What is claimed is:

1. A shipping container comprising a first container portion providing a floor, and four upstanding side walls in two opposed pairs, a first pair of opposed side walls of the first container portion being provided with facing first engaging mean for engaging a partition member, one engaging means provided on each of the opposed side walls of the first pair, a second container portion providing a floor and four upstanding side walls in two opposed pairs, a first pair of opposed side walls of the second container portion being provided with facing first engaging means for engaging the partition member, the side walls of the second container portion providing a flange extending generally perpendicularly to the side walls, and the side walls extending beyond the flange, the opposed side walls of the second container portion being spaced to permit them to be engaged selectively in either an upright or inverted orientation within the perimeter provided by the opposed side walls of the first container portion to the flange, and a first interior partition comprising second engaging means for engagement with the first engaging means on the first pair of opposed walls of each of the first and second container portions to divide the interior of the first and the second container portions.

2. The shipping container of claim 1 wherein a second pair of opposed side walls of each of the first and second container portions is provided with facing first engaging means, one engaging means being provided on each opposed side wall of the pair.

3. The shipping container of claim 2 further comprising a second interior partition including second engaging means for engagement with the first engaging means on the second pair of opposed side walls of each of the first and second container portions.

4. The shipping container of claim 3 wherein the second interior partition comprises a layer of shock-absorbent material.

5. The shipping container of claim 4 wherein the first and second interior partitions are complementarily notched for use conjunctively to divde the chamber provided by the first and second container portions into a plurality of regions.

6. The shipping container of claim 1 wherein the first pair of opposed side walls of each of the first and second container portions is provided with a plurality of pairs of facing first engaging means, one engaging means of each pair being provided on each opposed side wall of the pair, and the first interior partition includes second engaging means for selective engagement with any respective pairs of first engaging means of the first and second container portions to divide the chamber provided by the first and second container portions selectively.

7. A shipping container comprising a first container portion providing a floor, and four upstanding side walls in two opposed pairs, a first pair of opposed side walls provided with a facing, inwardly opening pair of grooves, one groove of the pair provided in each of the opposed side walls of the first pair, a second container portion providing a floor and four upstanding side walls in two opposed pairs, the side walls of the second container portion providing a flange extending generally perpendicularly to the side walls, and the side walls extending beyond the flange, the opposed side walls of the second container portion being spaced to permit them to be engaged snugly within the oerimeter provided by the opposed side walls of the first container portion down to the level of the flange, the opposed side walls being selectively engaged in either an upright orientation to provide a hollow lid or in an inverted orientation to provide a nestable lid, and a first interior partition sized for sliding engagement in the pair of grooves to divide the interior of the first container portion, a first pair of opposed side walls of the second container portion provided with a facing, inwardly opening pair of grooves, one groove of the pair being provided in each of the opposed side walls of said first pair, and the first interior partition sized for sliding engagement in said pairs of grooves of said first and second container portions to divide the chamber provided by the first and second container portions.

* * * * *

UNITED STATES PATENT AND TRADEMARK OFFICE

CERTIFICATE OF CORRECTION

PATENT NO. : 4,602,715

DATED : July 29, 1986

INVENTOR(S) : Paul H. Sarver, Donald K. Sears & Gary A. Robbins

It is certified that error appears in the above-identified patent and that said Letters Patent is hereby corrected as shown below:

At column 6, line 27, delete "divde" and insert therefor --divide--;

At column 6, line 52, delete "oerimeter" and insert therefor --perimeter--; and

Signed and Sealed this

Fourth Day of November, 1986

[SEAL]

*Attest:*

DONALD J. QUIGG

*Attesting Officer*

*Commissioner of Patents and Trademarks*